US008636264B2

(12) United States Patent
Donaldson et al.

(10) Patent No.: US 8,636,264 B2
(45) Date of Patent: Jan. 28, 2014

(54) POWDER METAL COMPONENT TOLERANCE IMPROVEMENTS

(75) Inventors: Ian W. Donaldson, Jefferson, MA (US); Michael C. Doran, Dubois, PA (US); James T. Young, II, Force, PA (US)

(73) Assignee: GKN Sinter Metals, LLC, Auburn Hills, MI (US)

( * ) Notice: Subject to any disclaimer, the term of this patent is extended or adjusted under 35 U.S.C. 154(b) by 896 days.

(21) Appl. No.: 12/664,181

(22) PCT Filed: Jun. 13, 2008 (Under 37 CFR 1.47)

(86) PCT No.: PCT/US2008/066897

§ 371 (c)(1), (2), (4) Date: Jun. 16, 2010

(87) PCT Pub. No.: WO2008/157340

PCT Pub. Date: Dec. 24, 2008

(65) Prior Publication Data

US 2011/0143158 A1 Jun. 16, 2011

Related U.S. Application Data

(60) Provisional application No. 60/943,737, filed on Jun. 13, 2007.

(51) Int. Cl.
*F16K 1/42* (2006.01)
*B22F 5/00* (2006.01)

(52) U.S. Cl.
USPC ..... 251/359; 251/362; 251/368; 419/28; 29/888.44

(58) Field of Classification Search
None
See application file for complete search history.

(56) References Cited

U.S. PATENT DOCUMENTS

| | | | | | |
|---|---|---|---|---|---|
| 2,153,397 | A | * | 4/1939 | Sandler | 384/279 |
| 2,198,654 | A | * | 4/1940 | Calkins et al. | 464/9 |
| 2,331,909 | A | * | 10/1943 | Hensel et al. | 428/553 |
| 2,975,677 | A | * | 3/1961 | Kelly, Jr. | 89/16 |
| 2,999,704 | A | * | 9/1961 | Haller et al. | 384/202 |
| 3,152,205 | A | * | 10/1964 | Sinkler | 264/249 |
| 3,445,148 | A | * | 5/1969 | Grad et al. | 384/279 |

(Continued)

FOREIGN PATENT DOCUMENTS

| | | |
|---|---|---|
| EP | 0014285 A1 | 8/1980 |
| FR | 2848245 A1 | 6/2004 |

(Continued)

OTHER PUBLICATIONS

International Search Report and Written Opinion Corresponding to PCT/US08/066897 under date of mailing of Dec. 17, 2008.

(Continued)

*Primary Examiner* — John J Zimmerman
(74) *Attorney, Agent, or Firm* — Quarles & Brady LLP

(57) ABSTRACT

A powder metal component (34) has an outer diameter that is inserted in a bore of another component (18) during assembly with an interference fit between the two components. Ribs (30) are formed on the outer diameter of the component (34) during compaction and sintering of the component. The ribs (30) have a surface that has been compressed to a greater density than a surface (31) of the outer diameter between the ribs to produce a major diameter and effective roundness defined by high points of the ribs.

13 Claims, 4 Drawing Sheets

(56) References Cited

U.S. PATENT DOCUMENTS

| | | | | |
|---|---|---|---|---|
| 3,678,557 | A * | 7/1972 | Howard | 29/893.37 |
| 3,842,646 | A * | 10/1974 | Kuhn | 72/354.8 |
| 4,111,031 | A * | 9/1978 | Vennemeyer et al. | 72/359 |
| 4,429,018 | A * | 1/1984 | Stuemky | 428/546 |
| 4,599,110 | A | 7/1986 | Köhler et al. | |
| 4,907,330 | A * | 3/1990 | Akao et al. | 123/90.51 |
| 5,094,268 | A | 3/1992 | Morel et al. | |
| 5,326,079 | A | 7/1994 | Ferrando et al. | |
| 5,988,591 | A | 11/1999 | Akimoto et al. | |
| 6,151,941 | A * | 11/2000 | Woolf et al. | 72/102 |
| 6,164,168 | A | 12/2000 | Anderson | |
| 6,168,754 | B1 * | 1/2001 | Woolf et al. | 419/28 |
| 6,401,562 | B1 * | 6/2002 | De' Stefani | 74/462 |
| 6,422,755 | B1 | 7/2002 | Cadle et al. | |
| 2004/0177719 | A1 * | 9/2004 | Kosco | 75/246 |
| 2007/0283778 | A1 * | 12/2007 | Ichikawa et al. | 74/457 |
| 2010/0178190 | A1 * | 7/2010 | Colombo et al. | 418/161 |
| 2012/0132160 | A1 * | 5/2012 | Malen et al. | 123/90.15 |

FOREIGN PATENT DOCUMENTS

| | | | |
|---|---|---|---|
| JP | 62-010244 | A | 1/1987 |
| JP | 7224623 | A | 8/1995 |
| JP | 10280099 | A | 10/1998 |
| JP | 2003-041302 | A | 2/2003 |
| JP | 2004-82169 | A | 3/2004 |

OTHER PUBLICATIONS

European Patent Office; Supplementary European Search Report for corresponding European Application No. 08771001.8-2311; Dated May 8, 2011.

Japanese Patent Office; Notification of Reasons for Rejection (Non-final) for corresponding Japanese Patent Application No. 2010-512382 with translation; Mar. 12, 2013; 10 pages.

* cited by examiner

FIG. 1
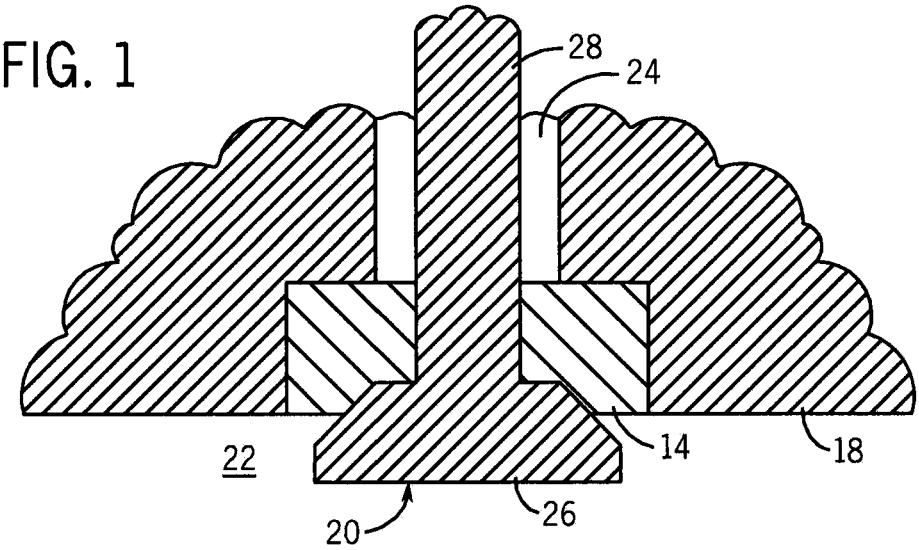
PRIOR ART
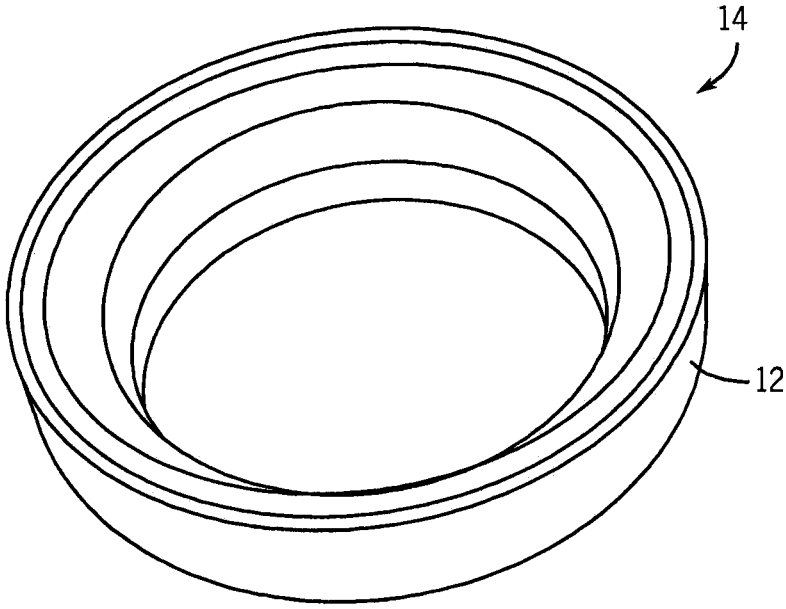
FIG. 2
PRIOR ART

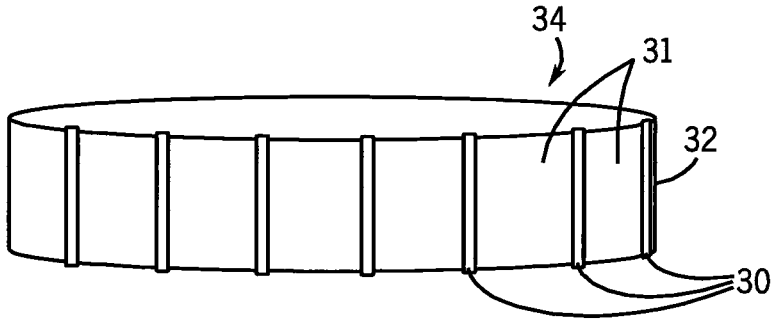
FIG. 4
FIG. 5
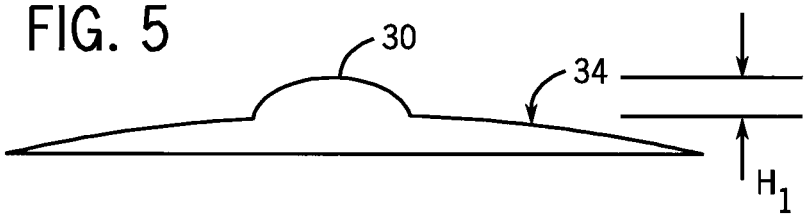
FIG. 6
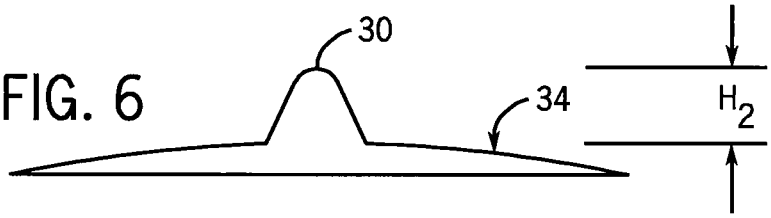
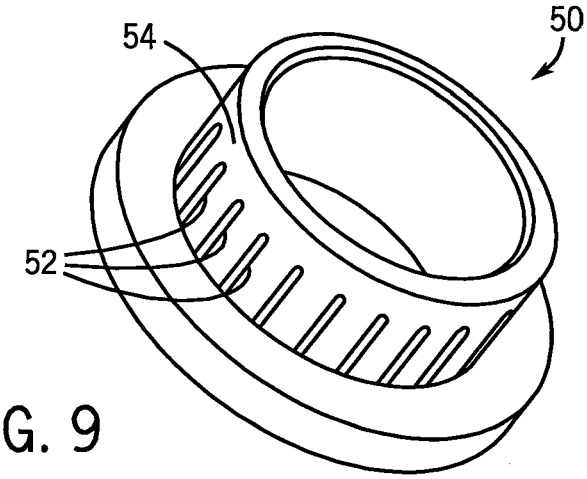
FIG. 9

POWDER METAL COMPONENT TOLERANCE IMPROVEMENTS

CROSS-REFERENCE TO RELATED APPLICATION

This claims the benefit of U.S. Provisional Patent Application No. 60/943,737 filed Jun. 13, 2007, which is hereby incorporated by reference.

STATEMENT CONCERNING FEDERALLY SPONSORED RESEARCH OR DEVELOPMENT

Not applicable.

FIELD OF THE INVENTION

This invention relates to improving dimensional tolerances in powder metal (PM) components, and in particular to accurately sizing the outer diameter (OD) of a cylindrical PM component such as a valve seat or valve guide.

BACKGROUND OF THE INVENTION

Valve seat inserts are typically installed in aluminum cylinder heads with an interference fit to seal off the combustion chamber from the cylinder head on the backside of the valve, and protect the aluminum cylinder head from damage by the valve seating directly against it. The valve seat must be wear and corrosion resistant at high temperatures, and able to conduct heat away from the valve to be absorbed by the cylinder head. Valve guides, which are also installed in the head with an interference fit, guide the stem part of the valve and so also must be wear resistant, and must be able to conduct heat from the stem to the cylinder head.

Cast iron, brass alloys and sintered powder metal have been used for valve seats. Sintered powder metal finds application to the most severe service, because of its excellent wear, corrosion and heat resistance, and thermal conductivity. However, the components must be made to extremely tight tolerances to achieve a suitable interference fit, and therefore have required machining to remove material from the OD and make the part round and of the accurate diameter. To permit efficient machining, the powder metal alloy of the valve seat or guide has sometimes been formulated to be more machinable, however, at the expense of wear and heat resistance. Even if machinable, it still required machining, which requires additional manufacturing processes and tooling costs.

SUMMARY OF THE INVENTION

The present invention provides a component and method of making it that enables using a relatively wear and heat resistant powder metal alloy while still providing good accuracy in size and roundness. In the invention, ribs are formed into the OD of the component during compaction, the component is sintered and then coined to size and shape.

In a preferred form, the ribs are axial ribs, like splines, and may or may not run for the length of the component.

If the ribs are on the outermost diameter of the component or the component is of a single OD, the component can be forced through a die that deforms the ribs permanently to create an effective diameter of the desired size and round shape, defined by the peaks of the ribs. Ideally, no subsequent machining to resize or reshape the effective diameter is required.

The coined ribs must be short enough so as not to affect the sealing between the valve seat and the cylinder head, so as not to provide a leak path from the combustion chamber.

This design also permits lateral flow of the aluminum alloy material of the cylinder head into the spaces between the ribs, and deformation of the cylinder head by the ribs to securely lock into place the component using production line press-in forces.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

FIG. 1 is a schematic cross-sectional view on a valve seat inserted in a cylinder head and forming a seat with a valve;

FIG. 2 is a perspective view of a typical valve seat;

FIG. 4 is a perspective view of a valve seat incorporating the invention;

FIG. 5 is a fragmentary end view illustrating one of the ribs of the invention;

FIG. 6 is a view like FIG. 5 of an alternate shape for the rib.

FIG. 9 is a schematic view of an alternate embodiment of a valve seat incorporating the invention.

DETAILED DESCRIPTION OF THE PREFERRED EMBODIMENT

Figure 3:
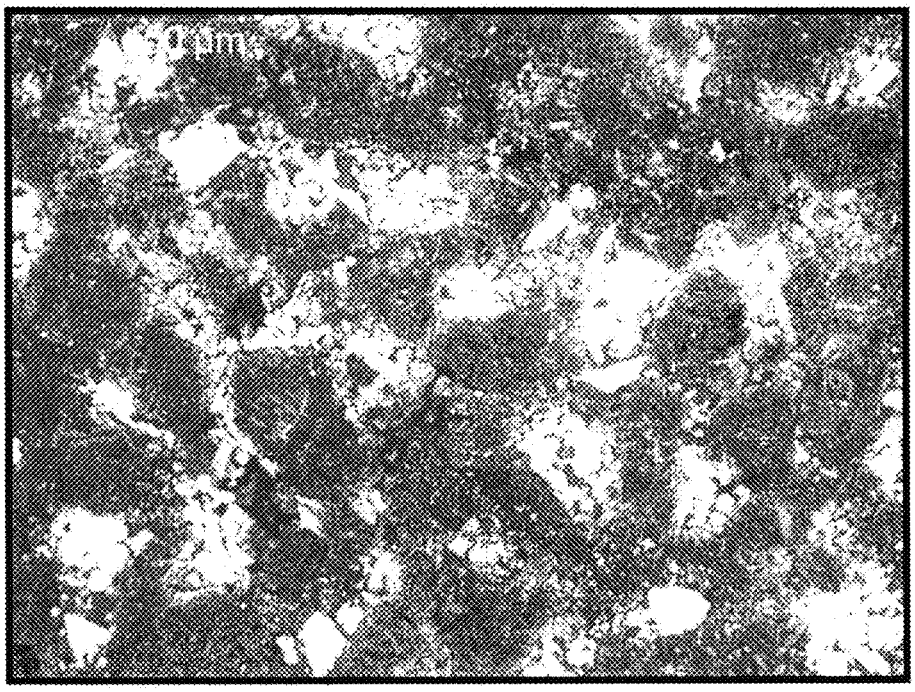
FIG. 3 PRIOR ART
FIG. 3 is a typical microstructure of an exhaust valve seat.

FIG. 1 schematically illustrates a valve seat 14 inserted in a bore 16 of a cylinder head 18 with an interference fit. Valve 20 seats against the valve seat to seal off the combustion chamber 22 from the passage 24 on the backside of the valve head 26. Valve stem 28 extends through passage 24, that could be lined with a valve guide insert, which is a tubular structure, that would be inserted in the cylinder head 18 with an interference fit.

FIG. 2 illustrates powder metal valve seat 14 as a typical valve seat, having an OD 12 that post sintering, pre-machining, would typically not be within tolerance and may be somewhat out-of-round, at least not within roundness tolerances. Tight tolerances needed for the interference fit of these seats in the cylinder head required grinding or other machining to bring them within tolerance on size and roundness.

A typical microstructure of a typical valve seat is shown in FIG. 3, consisting of a ferrous carrier phase (dark) and a high alloy hard phase (white). This material will not allow plastic deformation for tolerance improvement with the typical geometry of the valve seat.

Referring to FIG. 4, in accordance with the invention, during compaction, ribs 30 are formed on the OD 32 of a PM ring 34. The shape of these ribs may be as illustrated in FIG. 5, with a rounded shape, or in FIG. 6 with a more narrow peaked shape. The height $H_1$ of the more round ribs 30 in FIG. 5 may be less than 0.127 mm (<0.005") tall for example, and the height $H_2$ of the more peaked ribs may be a little taller, for example up to 0.152 mm (<0.006"). Preferably, the ribs are less than fully dense (7.4 g/cm$^3$) so that they are more deformable when they are coined. After coining the density at the coined surface is higher than the surface density of the outer diameter surface 31 between the ribs.

The ribs 30 can be sized to reduce the variation, i.e., the OD tolerance, of the OD and the variation in the OD roundness without requiring machining by plastically deforming them. Optimally, for rings that are basically straight wall such as valve guides and some valve seats, the coining process could be a high-speed pass through a bore in a die, the bore tapering to produce an OD on the part of the correct size and shape. These features provide a lower cost operation than machining for tolerances of less than 0.05 microns on the OD.

Figure 7:
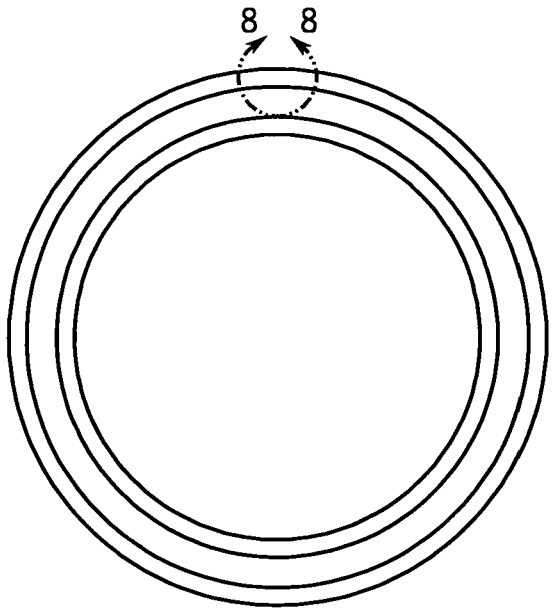
FIG. 7 is an end view illustrating a major diameter defined by high points of the ribs and a root diameter defined by low points of the valleys between the ribs.
Figure 8:
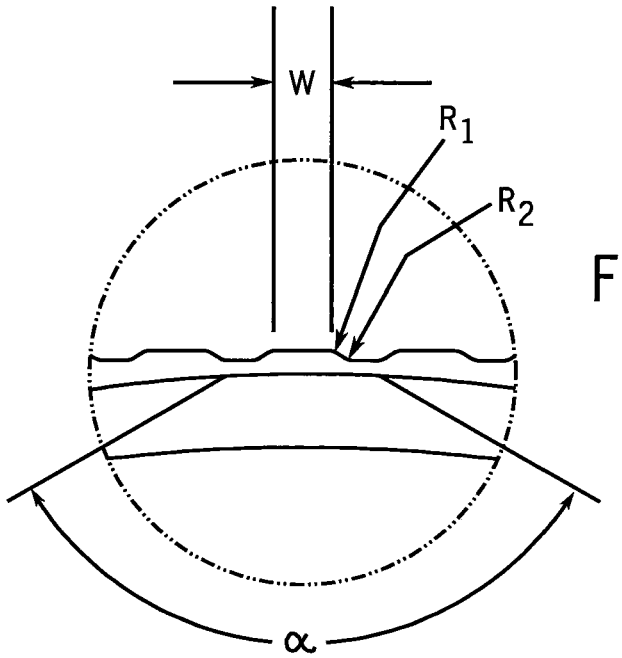
FIG. 8 is a detail view of portion 8-8 of FIG. 7.

FIGS. 7 and 8 illustrate the OD after sizing by coining. The major diameter defined by the high points or lands of the coined ribs is, for example, 28.278 mm and the root diameter defined by the bottoms of the valleys between the lands is for example 28.070 mm. In FIG. 8, the width W of the land may be 0.51 mm wide at the top with a radius $R_1$ of 0.25 mm at the edges of each land and a radius $R_2$ of 0.38 mm at the edges of each valley. The angle a may be, for example, 120 degrees. Prior to coining, the major diameter could be, for example, 28.278 +0.05 mm/−0.00 mm (or +0.075 mm/−0.00 mm). During coining, ribs would be flattened to some degree as necessary due to variation. Not all ribs may be flattened, as some may be at or below the nominal dimension.

This method can be used on materials that are too hard for straight wall sizing such as valve seat materials that are susceptible to work hardening. Porosity would be collapsed along with some material plastic deformation, which provides a means for OD tolerance improvement on the outer OD. When press fit into a lower strength or higher ductility material, material will swage into any recessions, i.e., differences in OD size, remaining in the OD, providing locking and/or pressure tightness. This is especially important for valve seats with leakage concerns. The most critical sealing surface in the valve train assembly is between the face of the valve and its seat in the cylinder head when the valve is closed. Leakage between these surfaces reduces engine compression and power and can lead to valve burning. Without work hardening the ID faces, machinability is not impaired. Radial location and number of the splines can vary based on the press fit force and/or sealing requirements. These can typically number between 10 and 72 splines, typically evenly spaced around the OD.

Additionally, the invention reduces overall press fit force due to a reduction in the surface area contact or allow for a greater tolerance for a press fit at a set force.

The invention can also be applied to valve seats that have a stepped outer diameter, as shown in the valve seat 50 in FIG. 9. The ribs 52 are not full height, and are on the smaller outer diameter of the part. For sizing these ribs, the part would have to be inserted into the die and withdrawn in the opposite direction. The end part 54 of the smaller outer diameter, that does not have the ribs on it, may taper down in diameter from the ends of the ribs to the end of the valve seat 52 to provide a lead-in when coining the ribs and when inserting the valve seat in the cylinder head. A lead-in taper may also be provided on the valve seat of FIG. 4.

A preferred embodiment of the invention has been described in considerable detail. Many modifications and variations to the preferred embodiment described will be apparent to a person of ordinary skill in the art. Therefore, the invention should not be limited to the embodiment described.

We claim:

1. A valve seat powder metal component having an outer diameter that will be inserted in a bore of another component during assembly with an interference fit between the two components, comprising ribs formed on the outer diameter of the powder metal component that are formed during compaction of the component and sintered with the component, the ribs having a surface that has been compressed to a greater density than a surface of the outer diameter between the ribs by coining to size and shape to produce a major diameter and effective roundness defined by high points of the ribs.

2. A powder metal component as claimed in claim 1, wherein the ribs are parallel to a longitudinal axial direction of the outer diameter of the valve seat.

3. A powder metal component as claimed in claim 2, wherein the ribs extend for the full length of the outer diameter of the valve seat.

4. A powder metal component as claimed in claim 2, wherein the ribs extend for less than the full length of the outer diameter of the valve seat.

5. A powder metal component as claimed in claim 1, wherein the valve seat has a single outer diameter.

6. A powder metal component as claimed in claim 1, wherein the valve seat has at least two different outer diameters with a step in between them, and ribs are formed on at least one of the outer diameters.

7. A method of making a valve seat having an outer diameter that is inserted in a bore of another component with an interference fit between the two components, comprising the steps of:

forming ribs on the outer diameter of the valve seat during compaction of the component;

sintering the valve seat; and plastically deforming the ribs by coining to size and shape before insertion into the bore of the other component to produce a major diameter and effective roundness defined by high points of the ribs.

8. A method as claimed in claim 7, wherein the ribs are deformed by passing the sintered valve seat through a bore in a die that interferes with at least some of the ribs.

9. A method as claimed in claim 7, wherein the ribs are parallel to a longitudinal axial direction of the outer diameter of the valve seat.

10. A method as claimed in claim 9, wherein the ribs extend for the full length of the outer diameter of the valve seat.

11. A method as claimed in claim 9, wherein the ribs extend for less than the full length of the outer diameter of the powder metal component.

12. A method as claimed in claim 7, wherein the valve seat has a single outer diameter.

13. A method as claimed in claim 7, wherein the valve seat has at least two different outer diameters with a step in between them, and ribs are formed on at least one of the outer diameters.

* * * * *

UNITED STATES PATENT AND TRADEMARK OFFICE

CERTIFICATE OF CORRECTION

PATENT NO. : 8,636,264 B2
APPLICATION NO. : 12/664181
DATED : January 28, 2014
INVENTOR(S) : Donaldson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1080 days.

Signed and Sealed this
Twenty-second Day of September, 2015

Michelle K. Lee

Michelle K. Lee
*Director of the United States Patent and Trademark Office*